US007694856B2

(12) United States Patent
Rossignol

(10) Patent No.: US 7,694,856 B2
(45) Date of Patent: Apr. 13, 2010

(54) CLOSURE DEVICE FOR A NON-VENTED LIQUID PRODUCT DISPENSER

(75) Inventor: Eric Rossignol, Chalon sur Saone (FR)

(73) Assignee: Rexam Dispensing SMT (FR)

( * ) Notice: Subject to any disclaimer, the term of this patent is extended or adjusted under 35 U.S.C. 154(b) by 420 days.

(21) Appl. No.: 11/556,564

(22) Filed: Nov. 3, 2006

(65) Prior Publication Data

US 2007/0084110 A1 Apr. 19, 2007

Related U.S. Application Data

(63) Continuation of application No. PCT/EP2004/004835, filed on May 6, 2004.

(51) Int. Cl.
*G01F 11/00* (2006.01)

(52) U.S. Cl. ..... 222/386

(58) Field of Classification Search ..... 222/386, 222/256, 259, 326, 387, 389, 327
See application file for complete search history.

(56) References Cited

U.S. PATENT DOCUMENTS

| | | | | | |
|---|---|---|---|---|---|
| 368,704 | A * | 8/1887 | Bryant | 222/386 |
| 3,215,320 | A * | 11/1965 | Heisler et al. | 222/326 |
| 3,377,003 | A * | 4/1968 | Bacon et al. | 222/386 |
| 4,394,939 | A * | 7/1983 | Thor et al. | 222/207 |
| 4,522,316 | A | 6/1985 | Hoffmann et al. | 222/327 |
| 4,598,843 | A * | 7/1986 | Foster et al. | 222/387 |
| 4,671,432 | A * | 6/1987 | Benecke et al. | 222/386 |
| 4,684,044 | A * | 8/1987 | Foster | 222/386 |
| 5,377,880 | A * | 1/1995 | Moretti | 222/207 |
| 5,449,094 | A * | 9/1995 | Behar et al. | 222/386 |
| 5,950,880 | A * | 9/1999 | Garcia | 222/321.7 |
| 5,961,005 | A * | 10/1999 | Pichonnier et al. | 222/386 |
| 6,056,164 | A * | 5/2000 | Wakayama | 222/327 |
| 6,310,931 | B1 * | 10/2001 | Gustafsson et al. | 376/440 |
| 6,375,045 | B1 * | 4/2002 | Ki | 222/386 |
| 6,889,875 | B2 * | 5/2005 | Lee et al. | 222/257 |
| 6,962,273 | B2 * | 11/2005 | Masuda | 222/321.9 |
| 7,306,124 | B2 * | 12/2007 | Masuda | 222/386 |
| 7,325,707 | B2 * | 2/2008 | Bougamont et al. | 222/390 |

FOREIGN PATENT DOCUMENTS

| | | |
|---|---|---|
| EP | 0 099 457 | 2/1984 |
| EP | 0 351 517 | 1/1990 |
| FR | 2 656 854 | 7/1991 |

OTHER PUBLICATIONS

International Search Report, Dec. 17, 2004, 2 pages.

* cited by examiner

*Primary Examiner*—Kevin P Shaver
*Assistant Examiner*—Jonathan Wood
(74) *Attorney, Agent, or Firm*—St. Onge Steward Johnston & Reens LLC

(57) ABSTRACT

A closure device for a non-vented liquid product dispenser from a rigid container including a and a movable bottom provided with a peripheral lip. The dispenser includes a base cup forming a casing fixable to the base of the container and receiving the bottom which is integrally and coaxially arranged thereinside after the production thereof and prior to product dispensing in such a way that the peripheral lip is protected.

11 Claims, 2 Drawing Sheets

CLOSURE DEVICE FOR A NON-VENTED LIQUID PRODUCT DISPENSER

CROSS-REFERENCE TO RELATED APPLICATIONS

The present application is a continuation of pending International patent application PCT/EP2004/004835 filed on May 6, 2004 which designates the United States, the content of which is incorporated herein by reference.

FIELD OF THE INVENTION

The present invention relates to a closure device for an airless dispenser for dispensing liquid product.

BACKGROUND OF THE INVENTION

The invention applies more particularly to the dispensing of cosmetic or pharmaceutical products from a rigid reservoir equipped in particular with means for withdrawing the product and with a movable bottom provided with sealing means.

As the user withdraws the product, the internal volume of the reservoir is reduced and, due to the absence of air, the bottom naturally moves upwards to compensate the vacuum thus created.

This movable bottom ensures, by sliding, the static and dynamic sealing with respect to the wall of the reservoir. The hermetic nature of the dispenser and the proper packaging of the product depend directly on the reliability of the sealing means of the bottom.

These sealing means, which are formed by moulding a thin wall using a flexible, deformable and fragile material, therefore have to be protected as soon as they leave the mould and up to the time of installation in the reservoir, so as to avoid any risk of subsequent leakage.

The object of the present invention is to solve this technical problem in a satisfactory manner.

SUMMARY OF THE INVENTION

This object is achieved by means of a device comprising an assembly consisting of a base element forming a casing, which is designed to be fixed to the base of said reservoir and inside which said bottom is designed to be housed integrally and coaxially at the time of manufacture and before dispensing the product, so as to protect said sealing means.

According to one advantageous feature, said base element has a central holding and blocking sleeve, in which an axial bushing borne by the outer face of the movable bottom is engaged in a sliding manner.

According to another feature, said sleeve opens out to the exterior at the lower part of said base element.

Said bushing and said central sleeve have, respectively, lower and upper bevelled edges which facilitate, by guiding, the fitting of said parts inside one another.

According to a first variant, said bottom consists of a dome-shaped part which is extended laterally towards the outside by a peripheral sealing lip.

Preferably, said lip is connected to the perimeter of said dome-shaped part by a concave portion which, by butting against the inner wall of the base element or reservoir, provides a non-return mechanism for the bottom.

According to another variant, said bottom consists of a cup which is extended laterally towards the outside by a ring, the upper and lower edges of which are each provided with a peripheral sealing lip.

According to yet another feature, said base element comprises snap-fastening elements which cooperate with complementary elements borne by the base of the reservoir.

According to another variant, the inside diameter of the base element is slightly greater than the inside diameter of the reservoir.

The device of the invention therefore comprises an assembly which is ready to install and which offers good protection to the movable bottom during the delicate operations of storage on leaving the mould, transfer to the assembly stations and installation on the reservoir.

This assembly thus constitutes a double bottom with a fixed outer part which forms both the base element for the reservoir and a casing for the inner part forming the movable bottom.

The separation of the movable bottom and its exit from the base element/casing forming the fixed bottom then its passage into the reservoir are carried out automatically by means of axial sliding in response to the vacuum created during the initial dispensing phase.

The filling of the reservoir is generally carried out in the inverted position of the dispenser (upside down), then the integral assembly consisting of base element/movable bottom is mounted on the open part of the reservoir in the manner of a lid before turning the dispenser over so as to place it in a vertical storage and use position in which the withdrawing means are arranged in the top part.

All these operations are carried out without any contact with the movable bottom, which remains enclosed in the base element.

Where appropriate, activation may comprise an operation consisting in extracting the movable bottom from the base element by exerting a slight axial thrust through the central bore of the sleeve, which also makes it possible to evacuate any residual air enclosed inside the reservoir after packaging the product.

BRIEF DESCRIPTION OF THE DRAWINGS

The invention will be better understood on reading the following description with reference to the drawings, in which.

DETAILED DESCRIPTION OF THE INVENTION

The device shown in the figures is designed to be installed on airless dispensers for dispensing liquid or semi-liquid products.

This type of dispenser is in particular equipped with a reservoir and with means for withdrawing the product, such as a pump (not shown).

Within the context of the present invention, the reservoir is designed in the form of a rigid container R comprising a movable bottom 1.

Figure 1:
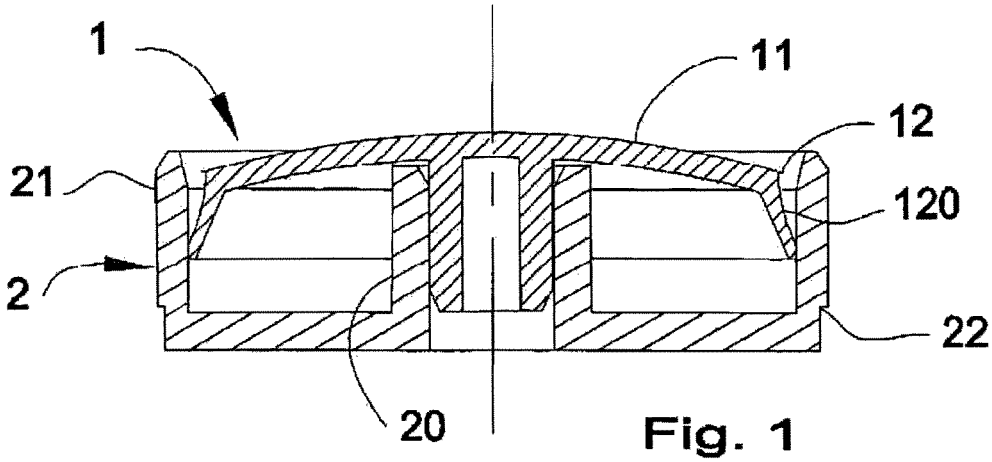
FIG. 1 shows a view in axial section of one embodiment of the device of the invention prior to assembly on a reservoir.
Figure 2:
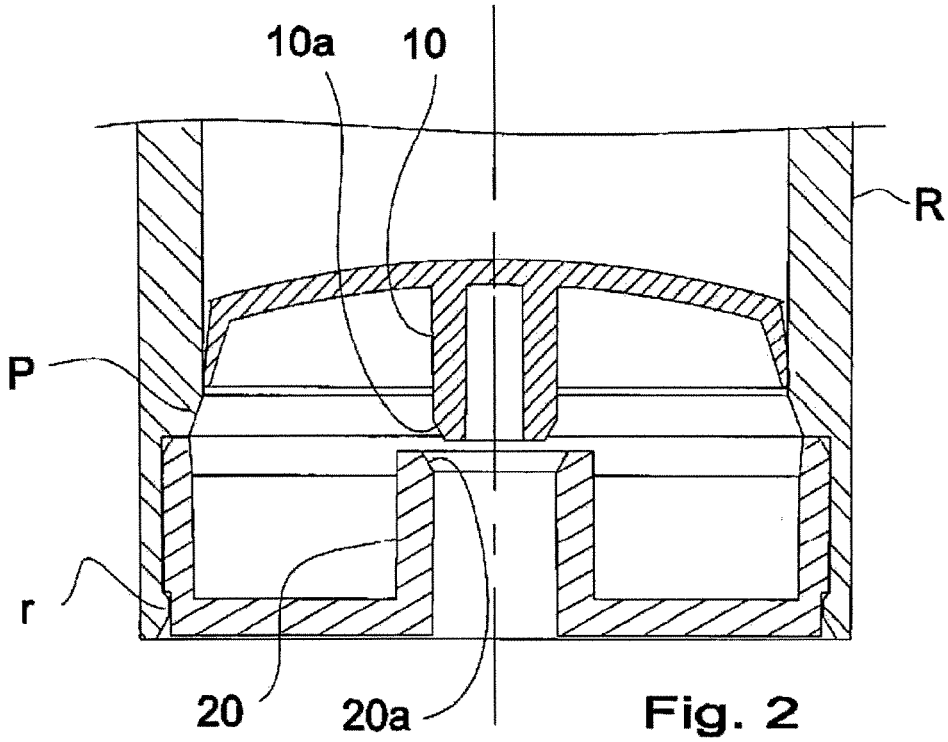
FIG. 2 shows a view in axial section of the device of FIG. 1, after assembly on a reservoir and activation of the dispenser.

The bottom 1 shown in FIGS. 1 and 2 seals the dispenser in the lower part and moves upwards by sliding inside the reservoir R (FIG. 2) under the effect of the internal vacuum following the exit of successive doses of product which are dispensed.

In the variant of FIGS. 1 and 2, the bottom 1 consists of a dome-shaped part 11 and has sealing means in the form of a peripheral lip 12 which extends the dome-shaped part 11 laterally and towards the outside and which, in addition, scrapes the inner wall of the reservoir R during the displacement of the bottom between two rest positions.

The lip 12 is connected to the perimeter of the dome-shaped part 11 of the bottom by a concave portion 120 which, by butting against the inner wall of the reservoir R, provides directional blocking of the movable bottom 1 in the downward and/or outward direction.

Figure 3:
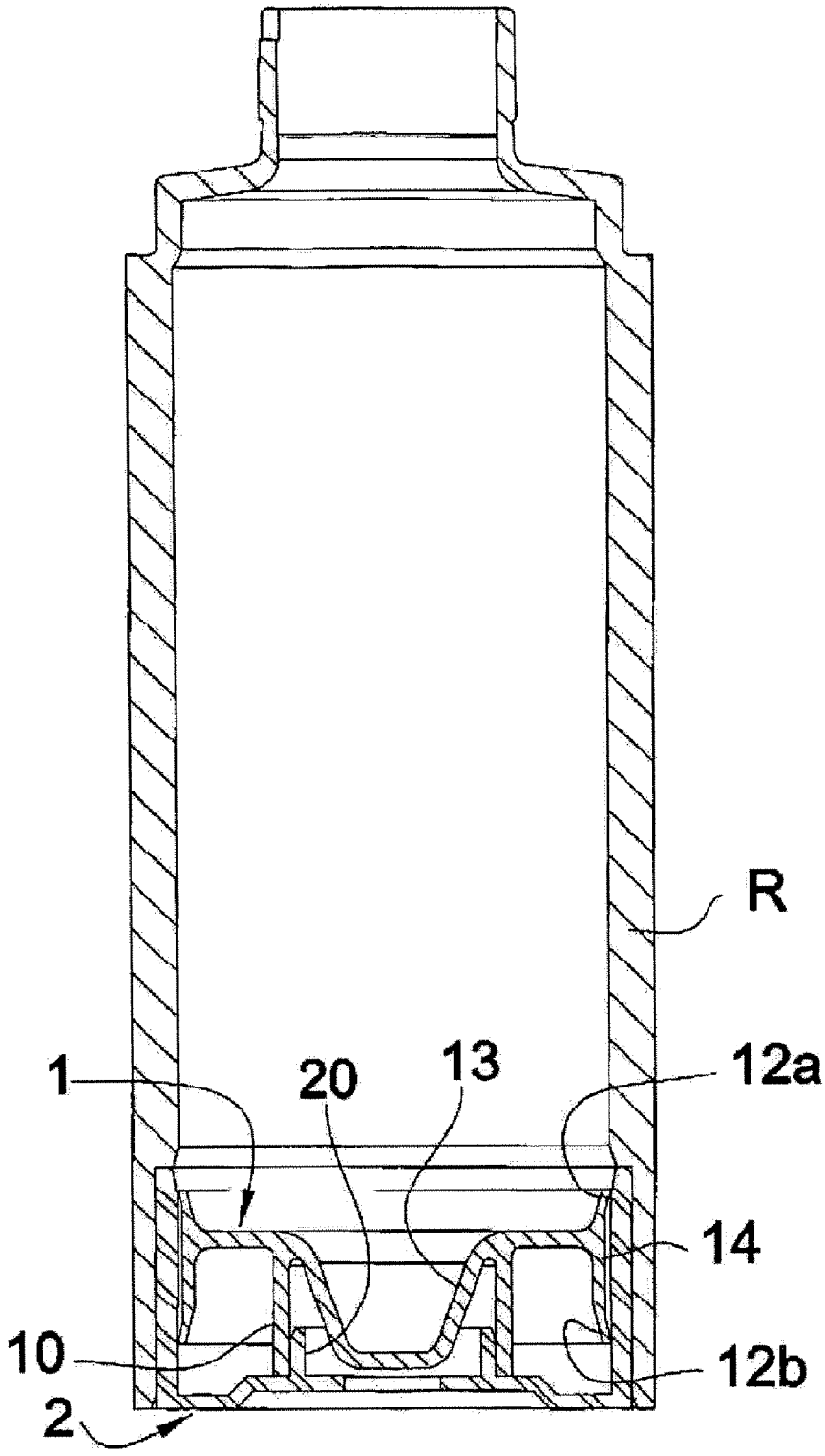
FIG. 3 shows a view in section of another embodiment of the invention.

In the variant of FIG. 3, the bottom 1 consists of a cup 13 which is extended laterally towards the outside by a ring 14, the upper and lower edges of which are each provided with a peripheral sealing lip 12*a*, 12*b*, the structure of which is analogous to that of the lip 12 in the variant shown in the previous figures.

These lips, which are generally formed with an elastomeric material, are fragile, particularly at their thinner end which is designed to come into bearing contact, under slight stress, against the inner wall of the reservoir.

In order to protect them, it is provided according to the invention to place the bottom 1, as soon as it has been manufactured, in a base element 2 forming a casing, which is designed to be fixed to the base of the reservoir R immediately after the latter has been filled.

To this end, the base element 2 has a lateral skirt 21, the height of which is greater than or equal to that of the bottom 1 and comprises snap-fastening elements 22, produced here in the form of slots, which cooperate with complementary elements r borne by the base of the reservoir R.

The bottom 1 is received and housed integrally and coaxially in the base element 2 while waiting to be installed on the reservoir R, as shown in FIG. 1.

The base element 2 has a central sleeve 20 which opens out to the exterior and forms a duct for the inlet of air into the space between the bottom 1 and the base element, and in which an axial bushing 10 borne by the outer face of the bottom 1 engages in a sliding manner.

In the variant shown, the bushing 10 is hollow.

The cooperation between the bushing 10 and the sleeve 20 holds and blocks the bottom 1 and ensures correct abutment and positioning relative to the reservoir R with a view to the subsequent displacement of the bottom. The lower edge 10*a* of the bushing 10, and here also the upper edge 20*a* of the sleeve 20, are bevelled so as to facilitate, by guiding, their mutual engagement and the fitting of these parts into one another.

In the embodiment shown in FIG. 2, the base element 2 has been fitted inside the reservoir R.

However, the inside diameter of the base element 2 is slightly greater than the inside diameter of the reservoir R.

Under these conditions, the lower part of the inner wall of the reservoir R is provided with a slope P which facilitates the forced or automatic sliding of the lip 12 at the inner junction between the top of the skirt 21 of the base element 2 and the reservoir R.

However, it would also be possible to provide that the base element is fitted outside the reservoir, the wall of the reservoir then being inserted between the lip of the movable bottom and the skirt of the base element.

What is claimed is:

1. Closure device for an airless dispenser for dispensing liquid product, comprising a rigid reservoir equipped with a movable bottom provided with a peripheral sealing lip, a base element forming a casing and having a central sleeve extending through said base element which cooperates in a sliding manner with an axial bushing borne by an outer face of said movable bottom, said base element being mounted by snap-fastening elements to a base of said reservoir, and said movable bottom, including the portion thereof with said peripheral sealing lip, being housed coaxially within said base element at the time of manufacture and before dispensing the product, so as to protect said peripheral sealing lip.

2. Device according to claim 1, characterised in that said sleeve opens out to the exterior at a lower part of said base element.

3. Device according to claim 1, characterised in that said bushing and said central sleeve have, respectively, lower and upper bevelled edges which facilitate, by guiding, the fitting of said parts inside one another.

4. Device according to claim 1, characterised in that said movable bottom consists of a dome-shaped part which is extended laterally towards the outside by said peripheral sealing lip.

5. Device according to claim 4, characterised in that said peripheral sealing lip is connected to the perimeter of said dome-shaped part by a concave portion which, by butting against the inner wall of the base element or reservoir, provides a non-return mechanism for the bottom.

6. Device according to claim 1, characterised in that said movable bottom consists of a cup which is extended laterally towards the outside by a ring, the upper and lower edges of which are each provided with a peripheral sealing lip.

7. Device according to claim 1, wherein said snap-fastening elements cooperate with complementary elements borne by the base of the reservoir.

8. Device according claim 1, characterised in that the inside diameter of the base element is slightly greater than the inside diameter of the reservoir.

9. Device according to claim 1, wherein said base element includes a lateral skirt having a height greater than or equal to a height of said movable bottom.

10. Device according to claim 1, wherein said base element is mounted inside the base of said reservoir.

11. Device according to claim 1, wherein cooperation between the bushing and the sleeve holds said moveable bottom at the time of manufacture and before dispensing the product to ensure correct abutment and positioning of said moveable bottom relative to said reservoir.

* * * * *